US011358763B2

(12) United States Patent
Markarian et al.

(10) Patent No.: US 11,358,763 B2
(45) Date of Patent: Jun. 14, 2022

(54) CHILD RESISTANT STORAGE CONTAINER

(71) Applicant: CONTEMPO CARD COMPANY, Providence, RI (US)

(72) Inventors: Michael Markarian, Tiverton, RI (US); Colette Bazirgan, West Warwick, RI (US); Edward Benjamin, Cranston, RI (US)

( * ) Notice: Subject to any disclaimer, the term of this patent is extended or adjusted under 35 U.S.C. 154(b) by 0 days.

(21) Appl. No.: 16/978,533

(22) PCT Filed: Mar. 8, 2019

(86) PCT No.: PCT/US2019/021410
§ 371 (c)(1),
(2) Date: Sep. 4, 2020

(87) PCT Pub. No.: WO2019/173749
PCT Pub. Date: Sep. 12, 2019

(65) Prior Publication Data

US 2021/0371172 A1 Dec. 2, 2021

Related U.S. Application Data

(60) Provisional application No. 62/641,096, filed on Mar. 9, 2018, provisional application No. 62/677,508, filed on May 29, 2018, provisional application No. 62/677,830, filed on May 30, 2018.

(51) Int. Cl.

| | |
|---|---|
| ***B65D 6/06*** | (2006.01) |
| ***B65D 85/10*** | (2006.01) |
| ***B65D 50/02*** | (2006.01) |
| ***B65D 5/38*** | (2006.01) |
| ***B65D 77/04*** | (2006.01) |
| ***B65D 59/04*** | (2006.01) |
| *B65D 77/22* | (2006.01) |

(52) U.S. Cl.
CPC ..... *B65D 50/02* (2013.01); *B65D 5/38* (2013.01); *B65D 59/04* (2013.01); *B65D 77/04* (2013.01); *B65D 77/22* (2013.01); *B65D 2215/02* (2013.01)

(58) Field of Classification Search
CPC ..... B65D 5/38; B65D 50/02; B65D 59/04; B65D 77/04; B65D 77/22; B65D 2215/02
USPC ..... 206/1.5, 242, 247, 249, 252–255, 267, 206/270, 804, 807, 815
See application file for complete search history.

(56) References Cited

U.S. PATENT DOCUMENTS

| | | | | |
|---|---|---|---|---|
| 3,459,296 A | | 8/1969 | Berg | |
| 3,761,010 A | * | 9/1973 | Rosenburg, Jr. | B65D 5/38 229/125.125 |
| 4,120,400 A | | 10/1978 | Kotyuk | |
| 5,080,227 A | * | 1/1992 | Focke | B65D 5/38 206/273 |
| 5,111,973 A | | 5/1992 | Mueller | |

(Continued)

FOREIGN PATENT DOCUMENTS

WO WO2017/129996 A1 8/2017

*Primary Examiner* — Luan K Bui
(74) *Attorney, Agent, or Firm* — Feeney IP Law; Alan F. Feeney

(57) ABSTRACT

A child-resistant storage container comprising two rigid boxes of relatively equal height and width manufactured from or coated with materials that produce enough friction between the contact points of the boxes to retain the inner box in the outer box when shook.

17 Claims, 12 Drawing Sheets

(56) References Cited

U.S. PATENT DOCUMENTS

| | | | | |
|---|---|---|---|---|
| 7,464,828 | B1 * | 12/2008 | Unrau | A47K 17/00 206/1.5 |
| D721,866 | S | 2/2015 | Giarraffa et al. | |
| 9,663,266 | B2 | 5/2017 | Schwester | |
| 10,479,581 | B2 * | 11/2019 | Chambers | B65D 5/0254 |
| 2003/0057116 | A1 * | 3/2003 | Davis | A24F 15/18 206/242 |
| 2003/0057117 | A1 * | 3/2003 | Davis | A24F 15/18 206/242 |
| 2005/0241966 | A1 * | 11/2005 | Giannini | B65D 5/38 206/242 |
| 2011/0011765 | A1 | 1/2011 | Gelardi et al. | |
| 2013/0248392 | A1 * | 9/2013 | Roila | B65D 85/1036 206/255 |
| 2013/0270130 | A1 * | 10/2013 | Ghini | B65B 61/20 206/242 |
| 2014/0262839 | A1 | 9/2014 | Thanhhung et al. | |

* cited by examiner

FIG. 9A
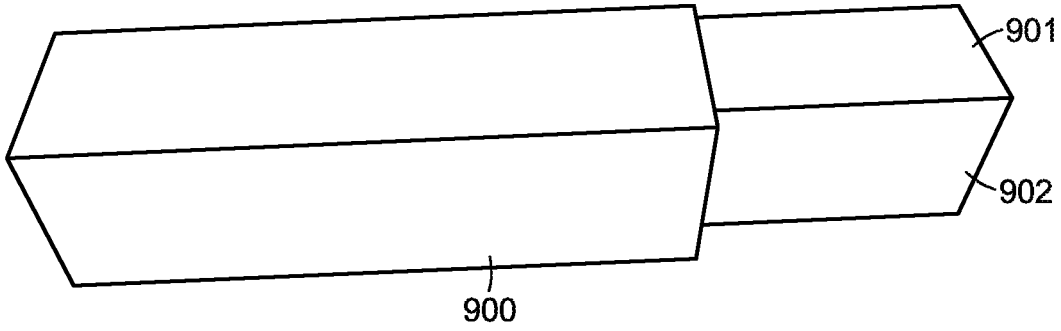
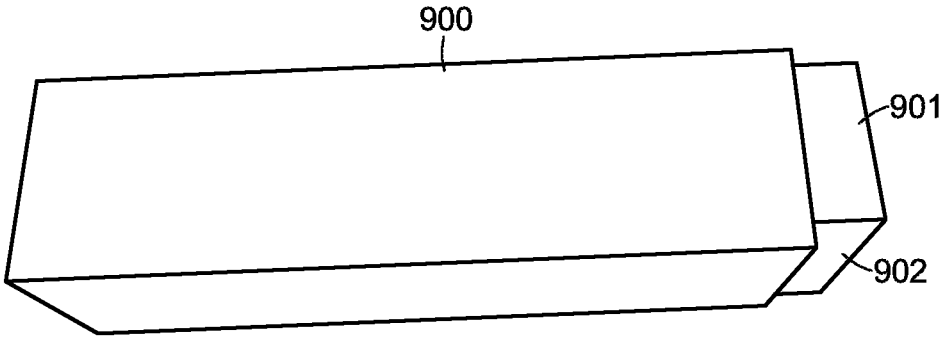
FIG. 9B
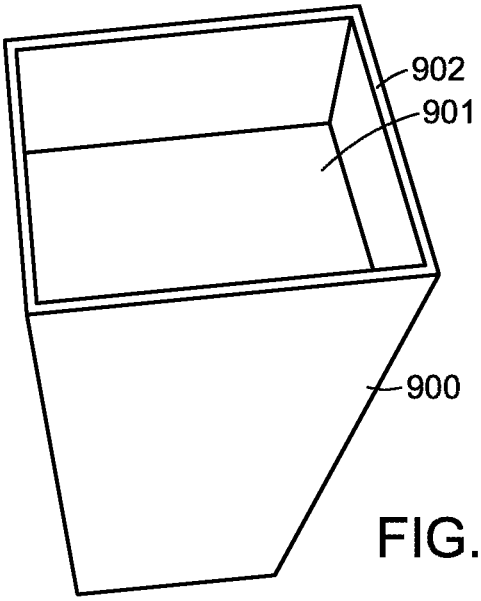
FIG. 9C

CHILD RESISTANT STORAGE CONTAINER

CROSS REFERENCE TO RELATED APPLICATIONS

This application is a continuation under 35 U.S.C. § 371 of International Application No. PCT/US2019/021410 filed on Mar. 8, 2019 that claims priority to U.S. Provisional Patent Application Ser. No. 62/641,096 filed on Mar. 9, 2018, U.S. Provisional Patent Application Ser. No. 62/667,508 filed on May 5, 2018, U.S. Provisional Patent Application Ser. No. 62/677,830 filed on May 30, 2018 and U.S. Provisional Patent Application Ser. No. 62/815,723 filed on Mar. 8, 2019, all of which are hereby incorporated by reference herein in their entirety.

BACKGROUND OF THE INVENTION

The American Association of Poison Control Centers reports that Poison Control centers across the US average 3.0 million calls annually and the vast majority of which are calls regarding an exposure. Every day in the United States there are 300 children ages 0-19 treated in the emergency department and 2 of these children die as a result of being poisoned. Accidental exposure to things like household items, chemicals, over-the-counter or prescription drugs poses a real threat to the safety of children around the world. One way to prevent accidental exposure is to package these potentially hazardous products in containers that make it difficult for children to access the contents. This type of packaging is referred to as child-resistant packaging and is regulated by the Poison Prevention Packaging Act.

The Poison Prevention Packaging Act (PPPA) was first introduced in 1972. The purpose of the PPPA is to protect children under 5 years old from poisonings or deaths that can occur when the child is exposed to hazardous products by opening the container and accessing its contents. A complete list of products that require child-resistant packaging can be found in the Code of Federal Regulations in Title 16, Part 1700.

A child-resistant package is one that is designed or constructed to be significantly difficult for children under 5 years old to open or obtain a harmful amount of the contents within a reasonable time. At the same time, the package must not be too difficult for an adult to use properly. A child-resistant package must be tested to meet the criteria of the PPPA. 85% of children tested must not be able to open the package within 10 minutes and 90% of adults must be able to open the package and re-close it so that it is child-resistant again within 5 minutes. These criteria must be met in 1-4 testing panels of 50 children between ages 42 and 51 months and a panel of 100 adults aging between 50-70 years.

It is important to note that a child-resistant package does not mean child-proof package. The criteria required for child-resistant packaging means that still 15% of children under age 5 are able to open the package in under 10 minutes. Child-resistant packaging protects many children from accidental exposure to hazardous substances, but there are still many children that do gain access the hazardous contents of the package resulting in a poisoning or even death of the child. There is a tremendous need for improved child-resistant packaging in order to protect children across the world. This is especially true in the growing cannabis industry.

Cannabis, also known as marijuana, is a plant that is commonly used for its psychoactive effect. It is used both medically and recreationally. Medical marijuana is used for conditions like chronic pain, cachexia, and seizures. Marijuana is either inhaled by smoking or vaporizing or it is ingested in edible forms such as baked goods, candies, or beverages. Acute marijuana toxicity is when a person experiences immediate adverse effects from marijuana. The active component of marijuana is delta-9-tetrahydrocannabinoid (THC). THC binds to and activates cannabinoid receptors in various parts of the brain. This affects the normal function of the brain in terms of memory, thought, concentration, time and depth perception, and coordinated movement. Marijuana intoxication symptoms vary with age and size but can include sleepiness, difficulty breathing, seizures, and coma. The long-term effects of acute marijuana exposures on children are unknown.

The cannabis industry is growing. This once strictly illegal drug has gained legalization medically and recreationally. There are now 30 states and the District of Columbia that have legalized marijuana in some way. This includes 8 states and the District of Columbia that have legalized recreational marijuana. This legalization trend means that cannabis in its various forms is now more accessible than ever. Unintentional pediatric marijuana exposures in children 9 years and under were studied in the United States from 2005 through 2011 by measuring the call volume to U.S. poison centers. This study by Wang et al. found that the call rate in states where marijuana was decriminalized increased by 30.3% calls per year while rate in states where marijuana was illegal remained the same. Wang et al. also conducted a study of pediatric marijuana exposure in Colorado before and after recreational marijuana legalization compared to the rest of the United States. Colorado and Washington were the first states in the U.S. to legalize recreational marijuana in 2012. The study evaluated hospital admissions and regional poison center cases of children ages 0 through 9 years of age at Children's Hospital Colorado, Aurora from 2009 to 2015. The mean rate of marijuana related hospital visits increased from 1.2 per 100,000 population 2 years before recreational marijuana legalization to 2.3 per 100,000 population 2 years after legalization. The annual regional poison control cases increased more than 5-fold from 2009-2015 with an average increase of 34% per year while the rest of the United States had an increase of 19%. This study suggests that the legalization of marijuana influences the number of pediatric exposures to marijuana. With the legalization trend of marijuana in the United States, it is more important than ever to ensure that children are protected from accidental exposure by providing an improvement to child-resistant packaging for cannabis products.

BRIEF DESCRIPTION OF THE INVENTION

The disclosure is directed to a child-resistant storage container. More specifically, the device is comprised of two rigid boxes of relatively equal height and width manufactured from or coated with materials with a static co-efficient of friction that is higher than its dynamic co-efficient of friction. When the slightly smaller box is fully inserted into the interior of the slightly larger box, the material that the boxes are constructed from or coated with create enough static friction to retain the inner box in the outer box even when shook. One or more narrow slots is/are embedded into the outer larger box which allows the user to insert a key, coin or tip of a knife into said slot to push the inner box out of the outer box. The claimed container is designed so that the inner rigid box can only be accessed with the use of a key, coin, tip of a knife or the like. No additional bagging, as is required for many prior art containers, is needed for the current invention since the box itself meets the state and federal requirements for child resistant packaging.

BRIEF DESCRIPTION OF THE SEVERAL VIEWS OF THE DRAWINGS

FIG. 9A depicts the preferred embodiment wherein the inner box has been partially inserted into the interior of the outer box; FIG. 9B shows the inner box inserted further into the outer box; FIG. 9C shows the claimed device after the inner box has been completely inserted from the perspective of the missing outer wall of the outer box after the inner box has been completely inserted into the outer box; FIG. 9J depicts the outer box imprinted with the inventors' trademark, logo and domain name.

FIG. 13 also depicts the action of inserting the inner box into the outer box after the flap has been positioned to further prevent access of the inner box by a child;

DETAILED DESCRIPTION OF THE INVENTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

The instant invention solves several problems found in prior art child resistance storage containers. Most utilize "locking means," such as flaps or plastic clips, to make the container child resistant. These additional locking means tend to break, fall off or tear destroying the child resistant capability. Other prior art child resistance storage containers are large and not easily contained in a purse, knapsack or briefcase. Other prior art child resistance storage containers are flat, folding cartons that are complicated and difficult to use. The claimed container is rigid, does not use "locking means" that tend to break while being small enough to put in a purse, knapsack, brief case and the like. The instant invention is inconspicuous and retains its child-resistant properties throughout its lifetime.

As the cannabis industry is legalized and grows, there is a legitimate demand in the industry for brandable, child resistant packaging that better promotes a company's cannabis-based products. In addition, states that have legalized recreational cannabis use have compliance requirements that sellers of cannabis-based products use child resistant packaging. There are few options available for sellers that are both child resistant, yet aesthetically pleasing to potential customers.

Figure 1:
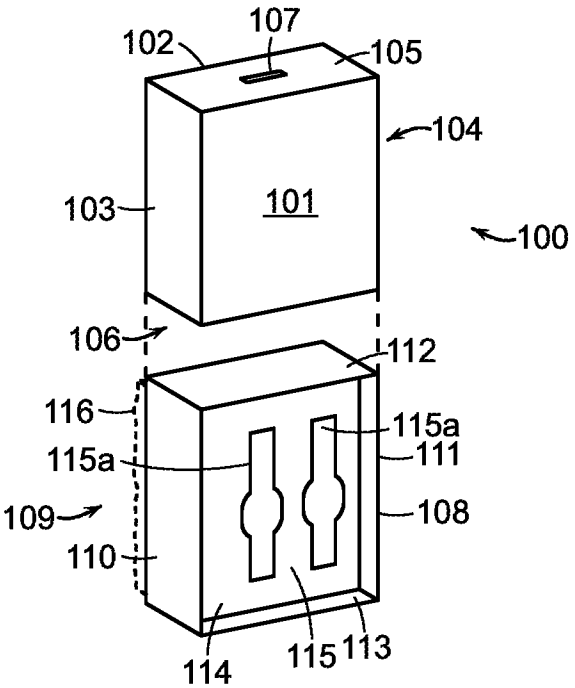
FIG. 1 is an illustration of preferred embodiment using rectangular shaped boxes.

As illustrated in FIG. 1, the device consists of an outer rectangular body (the "outer rectangular box") 100 in which a smaller rectangular body (the "inner rectangular box") 108 fits completely within. The outer rectangular box 100 has a top wall 101, a bottom wall 102, two vertical side walls 103, 104 and a front horizontal wall 105. The outer rectangular box 100 does not have back horizontal wall so as to provide access to insert the inner rectangular box 108 completely within interior space 106 of the outer rectangular box 100. The front horizontal wall 105 contains a narrow slot 107 (the "access slot") capable of accepting a thin object, such as the tip of a knife or letter opener or a coin such as a penny or dime. It is important for the integrity of the device to prevent access by small children that the narrow slot 107 not be wide enough for a small child's finger to access the inner rectangular box 108.

It should be appreciated that the slot may be formed of varying shapes, sizes or combinations of different shapes and sizes, provided that the slot does not allow a child to access the inner box once it is properly installed in the outer box.

The inner rectangular box 108 is designed to fit snugly in the interior of the outer rectangular box 100. It consists of a bottom wall 109, two vertical walls 110, 111, a front horizontal wall 112 and a back horizontal wall 113. The top wall is missing to provide access to the interior space 114 of the interior rectangular box 108 to store cannabis cigarettes or cartridges and other objects that the user wishes to keep from small children. The inner rectangular box 108 may also contain a pre-formed insert 115 with the shape of the object or objects 115*a* the user wishes to store embedded into said insert 115. In the preferred embodiment, an insert 115 formed with the shape of a cannabis cigarette/cartridge cutout/indentation 115*a* is used to secure said cigarette/cartridge in the claimed device in place without movement. The preferred insert 115 is made from plastic or foam and is made using injection molding, thermal forming, or vacuum forming processes or any other processes known in the art to manufacture mechanical parts.

It is important that the inner rectangular box 108 have a slightly smaller width and height than the outer rectangular box 100 to ensure that the inner rectangular box 108 remains within the outer rectangular box 100 even when the claimed device is shaken by an infant or toddler. The length of the inner rectangular box 108, however, is relatively much shorter than the length of the outer rectangular box 100 to prevent a toddler or small child from reaching within the outer rectangular box 100 to retrieve the inner rectangular box 108 when the device is being used. To maintain the child-resistant properties of the claimed device, the various components are, preferably, manufactured from high friction, rigid materials having a static co-efficient of friction that is greater than said material's dynamic co-efficient of friction. One or more of the bottom wall 109 and/or the two vertical walls 110, 111 of the inner rectangular box 108 (or in an alternative embodiment one or more of the top wall 101, bottom wall 102 and/or two vertical side walls 103, 104 of the outer rectangular box 100) is coated with a high-friction material such as foam 116. The additional foam layers 116 insure that the inner rectangular box 108 is retained within the outer rectangular box 100 even when the claimed invention is aggressively shaken. By design, the inner rectangular box 108 is only accessed by inserting a coin or tip of a knife through the narrow slot 107 in front horizontal wall 105 and further within the outer rectangular box 100 until the inner rectangular box 108 extends outward from the outer rectangular box 100 in which it was previously situated.

It should be appreciated that if the boxes are constructed from materials that create sufficient friction between the inner rectangular box and the outer rectangular box to maintain the inner rectangular box within the outer rectangular box when the claimed device is shaken, then there is no need for additional coating or layers of foam.

Various types of "coating" material may be used including plastics, rubbers, foams and the like. In the preferred embodiment, a layer of foam 116 is affixed to the bottom wall 109 of the interior rectangular box 108. Various types of foams, such as open cell polyurethanes, polyethylenes, polystyrenes, and latex rubber, preferably "polyurethane charcoal foam" traditionally found in camera cases, may be employed. The foam may be applied in situ. The foam may be pre-made as a thin strip, preferably by die cutting, that is affixed to a wall. Pre-formed strips may be affixed to one of the boxes using any known type of adhesive including, but not limited to, acrylics, contact adhesives, cyanoacrylics, epoxies, ethylene-vinyl acetate-based hot-melts, glue, hot melt adhesives, neoprene, paste, polymer dispersion adhesives, pressure sensitive adhesives, resins, polyimides, polyols, polyurethane, pressure sensitive adhesive, rubber cement, thermoset epoxies, thermosetting polymers, ultraviolet light curing adhesives, and urethanes.

Figure 2:
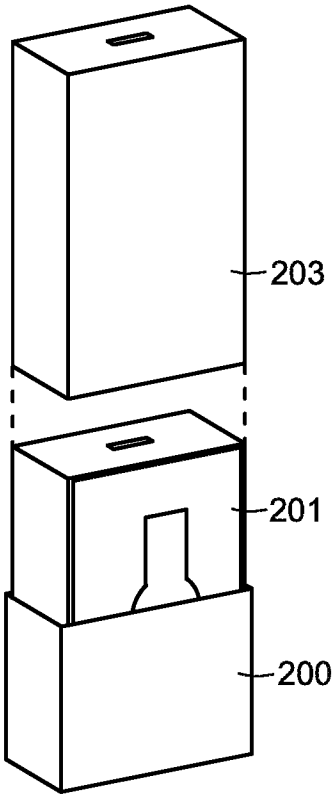
FIG. 2 is a depiction of FIG. 1 with an additional inner box in which the inner rectangular box is first inserted into.

FIG. 2 depicts FIG. 1 with an additional box feature 200. In this embodiment, a second rectangular box (the "second box") 200, large enough to completely contain a portion of the inner rectangular box 201, but small enough to be slid completely into the outer rectangular box 203, is used to retain the item stored in the inner rectangular box 201. In addition, it provides an additional contact with the inner walls of the outer rectangular box 203 which may be covered with a sheet of foam to provide further friction between the two boxes.

Figure 4:
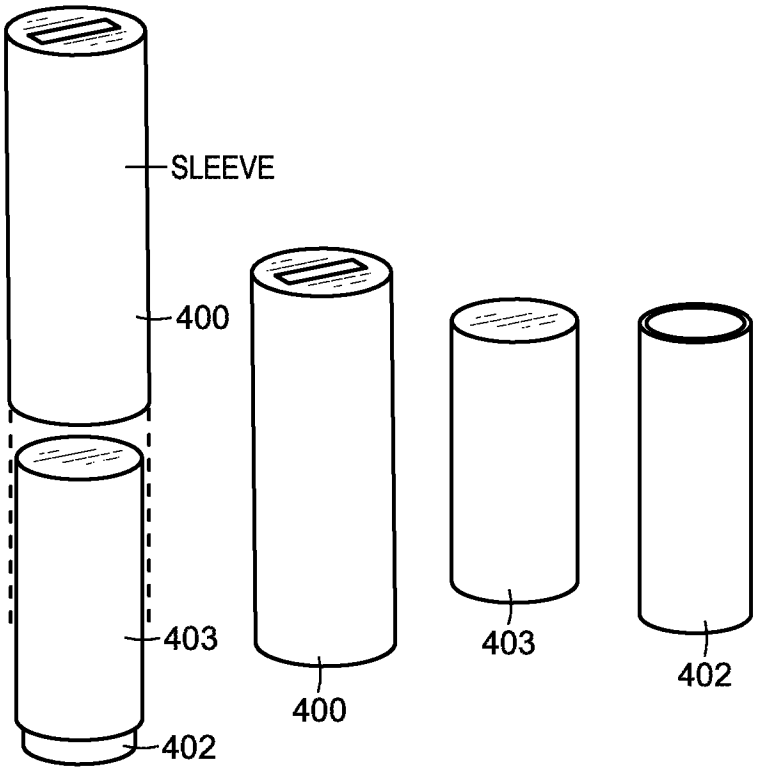
FIG. 4 is a depiction of FIG. 3 wherein the opposing side of the inner cylindrical box is inserted into the second inner cylindrical box.
Figure 3:
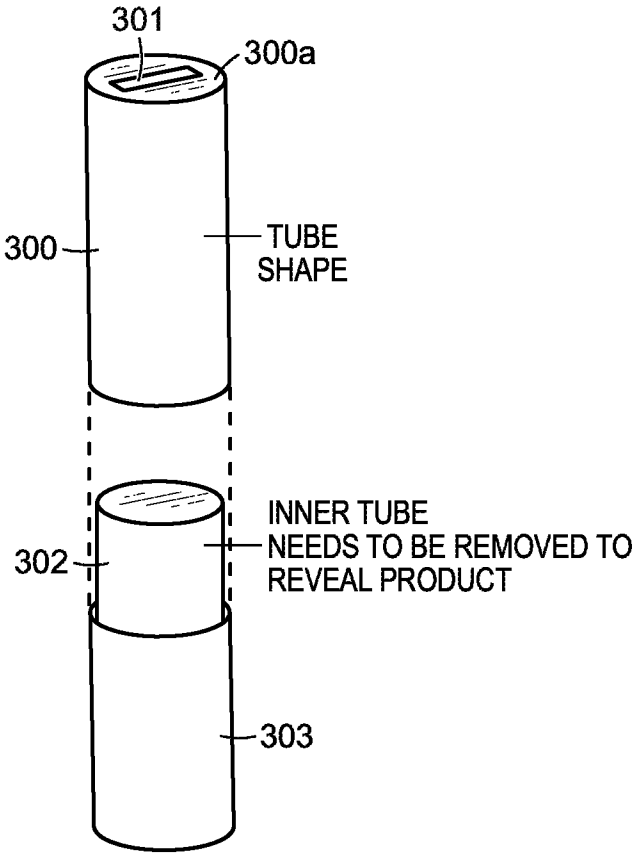
FIG. 3 is an illustration of a child resistant storage container using cylindrical boxes.

FIG. 3 illustrates the claimed device using cylindrical components. This example uses an outer "cylindrical" tube (the "outer cylindrical tube") 300 having a narrow slot 301 formed into its front horizontal wall 300*a*, an inner cylindrical tube (the "inner cylindrical tube") 302 having the ability to retain an object, preferably a cannabis cigarette or cartridge, that is slightly smaller than that outer cylindrical tube 300 so that it might be inserted completely into the outer cylindrical tube 300 and a second cylindrical tube (the "second cylindrical tube") 303 that fits over the inner cylindrical tube 302, but is slightly smaller than the outer cylindrical tube 300 into which it is inserted. In this embodiment, the inner cylindrical tube 302 must be separated from the second cylindrical tube 303 before the item contained therein can be removed. FIG. 4 is a depiction of the cylindrical device of FIG. 3 wherein the second cylindrical tube 403 is slid over the side of the inner cylindrical tube 402 that is first inserted into the outer cylindrical tube 400 whereas in FIG. 3, the second cylindrical tube 303 is slid over the end of the inner cylindrical tube 302 that is not initially inserted into the outer cylindrical tube 300.

Figure 5:
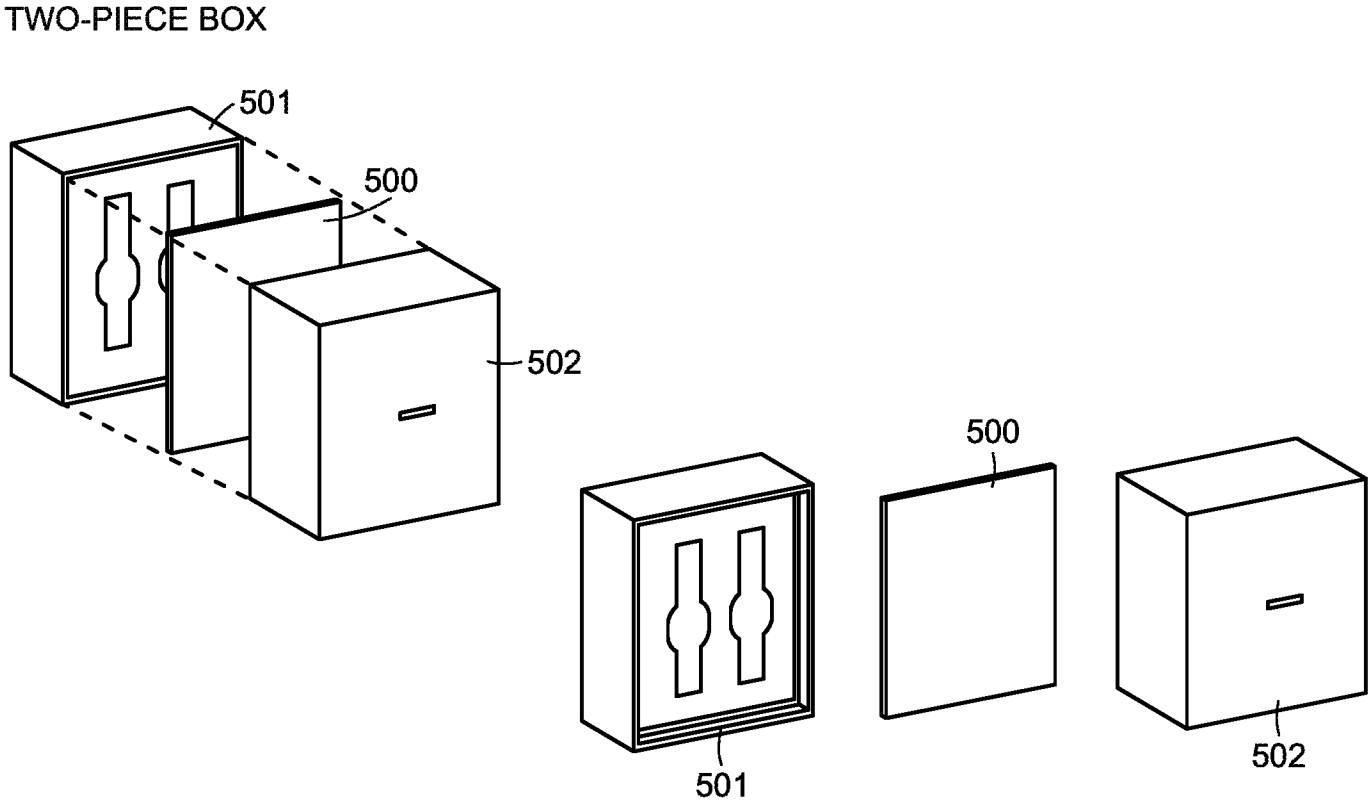
FIG. 5 is a depiction of FIG. 1 with an additional foam layer inserted between the inner rectangular box and the outer rectangular box.

FIG. 5 depicts FIG. 1 with an additional feature. In this example, a layer of thin foam 500 is secured over the open wall of the inner rectangular box 501. The inner rectangular box 501 with the additional layer of foam 500 is then inserted into the outer rectangular box 502. This additional feature, provides friction, as well as securing the items contained in the inner rectangular box 501.

Figure 6:
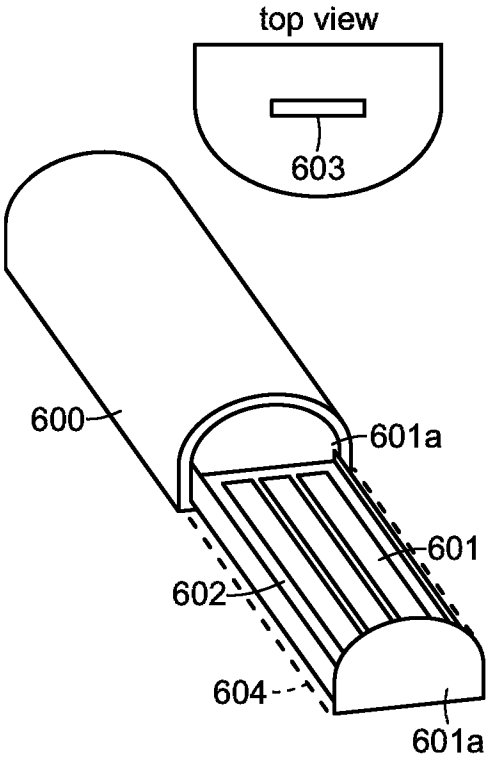
FIG. 6 is an example of the claimed device employing rounded boxes.

FIG. 6 is an example using rounded boxes, having a rounded outer box 600 and an inner box 601 with rounded edges 601*a*. The inner box 601 is designed with a rectangular insert 602 designed to hold cannabis cigarettes/cartridges. The outer rounded box 600 has a slot 603 punched into its leading horizontal wall 600*a* which allows the user to access the inner box 601 with a coin, key or other flat object to "push" the inner box 601 out of the outer box 600 when the user wants to access the cannabis cigarettes/cartridges contained therein. A resistant foam layer may also be affixed to the lower wall 604 of the inner box 601 to increase the static friction between the two boxes 600, 601.

Figure 7:
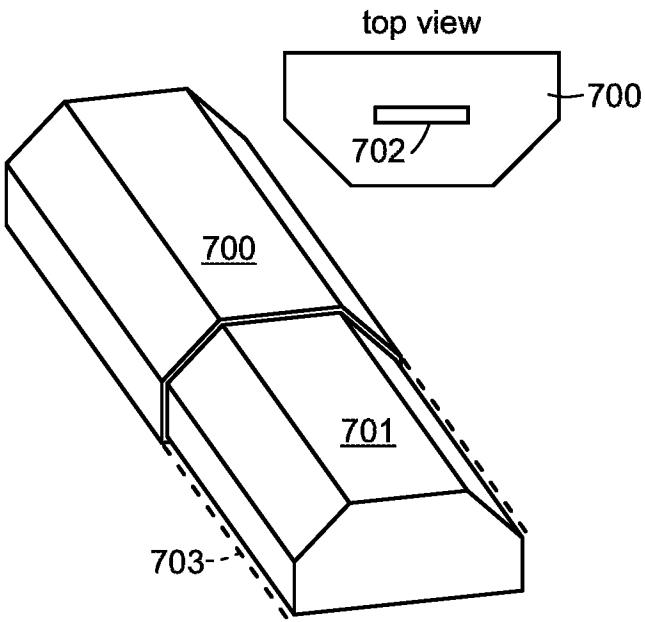
FIG. 7 is an example of the claimed device employing octagonal boxes.
Figure 7A:
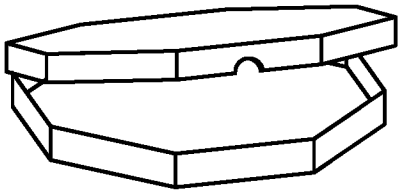

FIG. 7 is an example using an octagon shaped outer box 700 that houses a clamshell box FIG. 7A. The inner clamshell box 701 is inserted into the outer, octagonal box 700 that has a slot 702 punched into its leading horizontal wall 700*a* which allows the user to access the inner, clamshell box 701 with a coin, key or other flat object to "push" the inner clamshell box 701 out of the outer box 700 when the user wants to access the cannabis cigarettes/cartridges contained therein. A resistant foam layer may also be affixed to the lower wall 703 of the inner clamshell box 701 to increase the static friction between the two boxes 700, 701.

Figure 8:
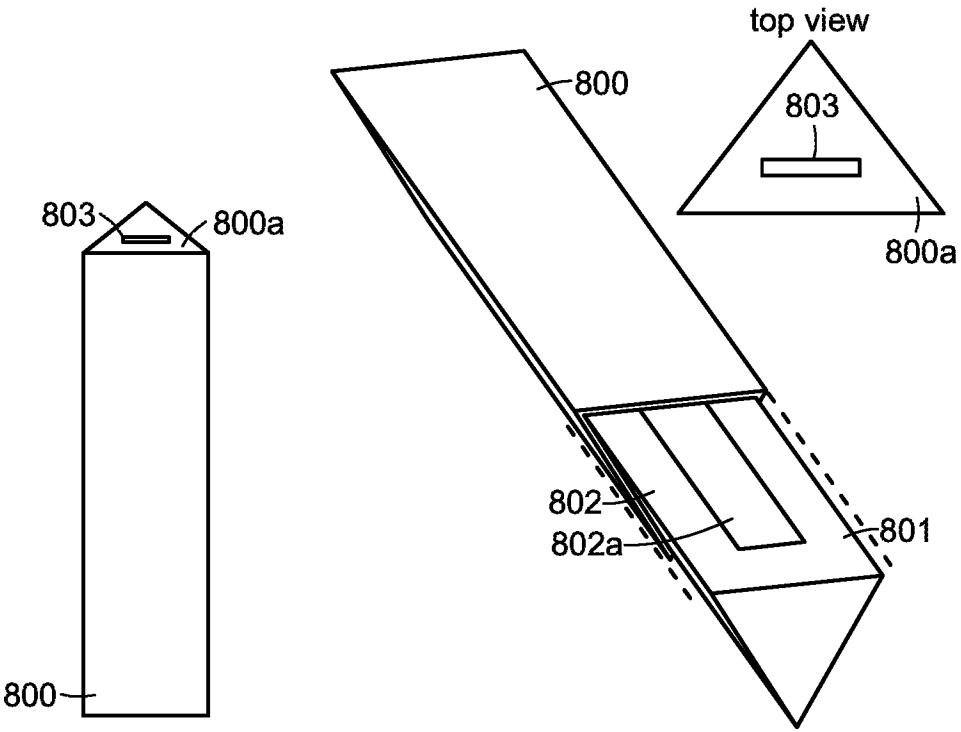
FIG. 8 is an example of the claimed device employing triangular boxes.

FIG. 8 is an example using triangular boxes. An inner, triangular box 801 having an insert 802 with cigarette-shaped indentations 802*a* is inserted into an outer, triangular-shaped box 800 having a slot 803 punched out of its upper horizontal wall 800*a*. The slot 803 allows the user to "push" out the inner box 801 with a coin, key or other flat object. The inner triangular box 801 may be encased in a resistant foam layer (not shown) to increase the static friction between the two boxes 800, 801.

Figure 9D:
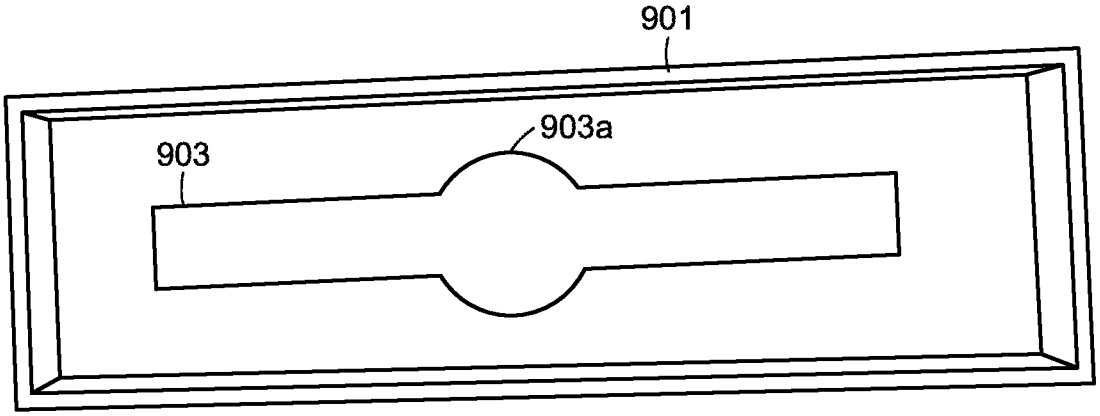
FIG. 9D illustrates the inner box having an insert with an indentation capable of accepting and storing a cannabis cigarette.
Figure 9E:
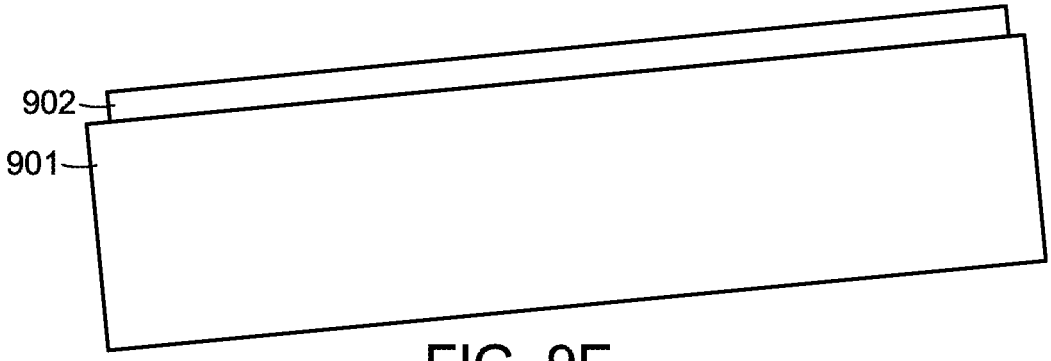
FIG. 9E is a side view of the inner box wherein a thin strip a foam applied to its underside.
Figure 9F:
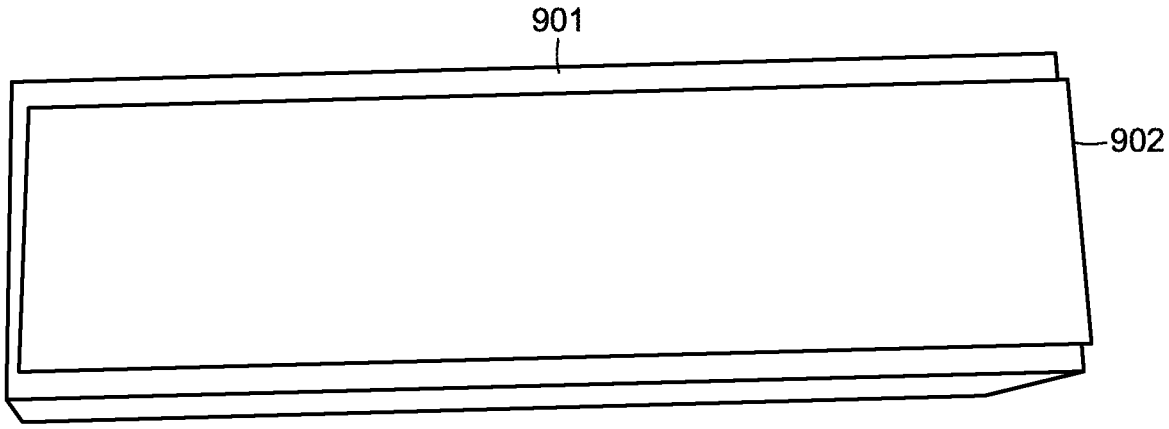
FIG. 9F is the underside of the inner box with a thin strip of foam applied thereto.
Figure 9H:
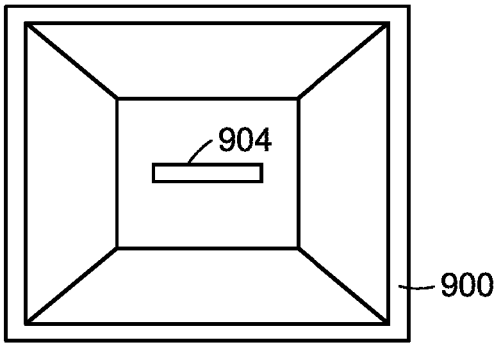
FIG. 9H is the outer box from the perspective of the access slot prior to the insertion of the inner box.
Figure 9G:
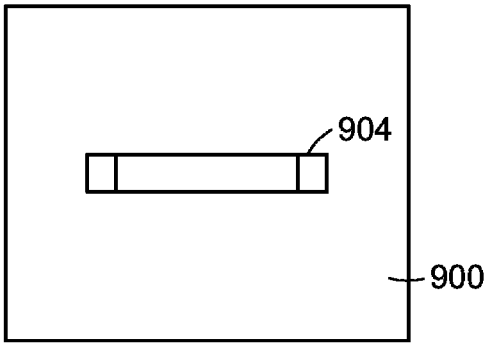
FIG. 9G is the outer box from the perspective of the open side looking into the interior of said outer box.
Figure 9I:
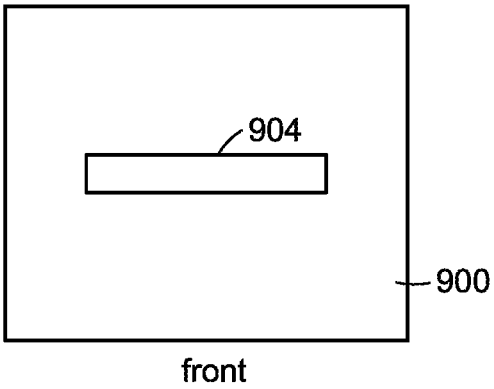
FIG. 9I depicts the box from the perspective of the slot after the inner box has been inserted completely into the interior of the outer box.
Figure 9I:
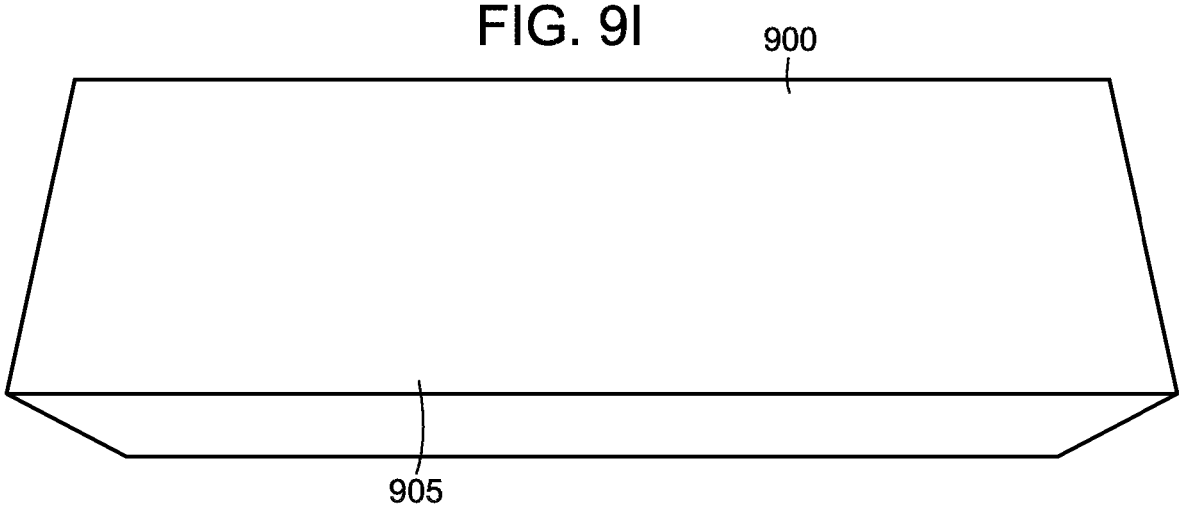

The preferred embodiment is represented by FIGS. 9A-9J. FIG. 9A-C illustrate the process of inserting the inner rectangular box completely into the outer box after the inner box has been completely inserted into the outer box FIG. 9I. It is important that the inner rectangular box, in its entirety, be situated within the outer rectangular box so as not to compromise the child resistance function. The leading wall of the inner rectangular box should be flush with the wall of the outer box containing the accessible slot FIG. 9G. An optional insert FIG. 9D formed with an indentation may be used to secure a cannabis cigarette without the cigarette moving around the inner box when the claimed invention is used. In the preferred embodiment of FIGS. 9E-F, a thin strip a foam is applied to the underside of the inner rectangular box to increase the static friction between the two boxes. The preferred embodiment uses a five-sided box with an open interior FIGS. 9G-H. As the cannabis industry grows and there is more competition between sellers, it will be important for suppliers/sellers to market their brand. As shown in FIG. 9J, the outer rectangular box has been imprinted with the inventors' trademark, logo and domain name. There are few options currently in the market place for suppliers/sellers of cannabis-based products that meet the strict, child resistant requirements while at the same time allowing for attractive packaging and product branding.

Figure 10A:
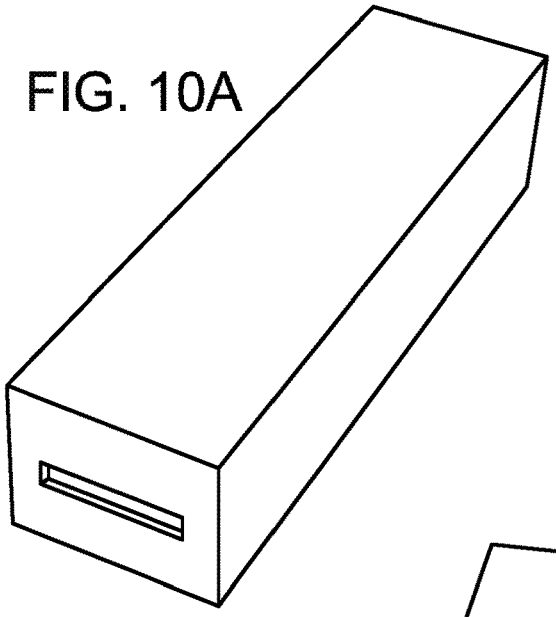
FIG. 10 depicts various stages of the claimed invention when the inner box is fully and partially inserted into the outer box.
Figure 10B:
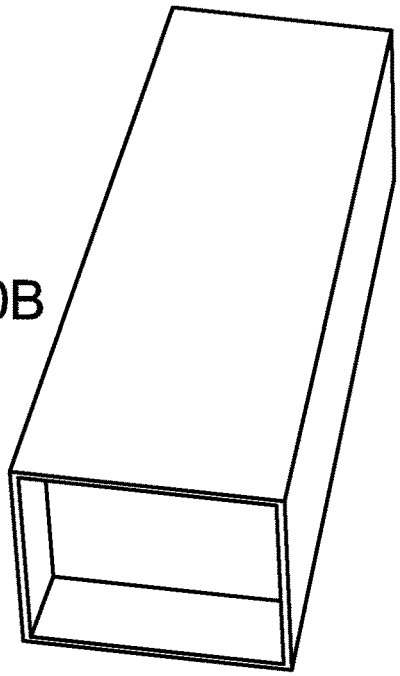
Figure 10C:
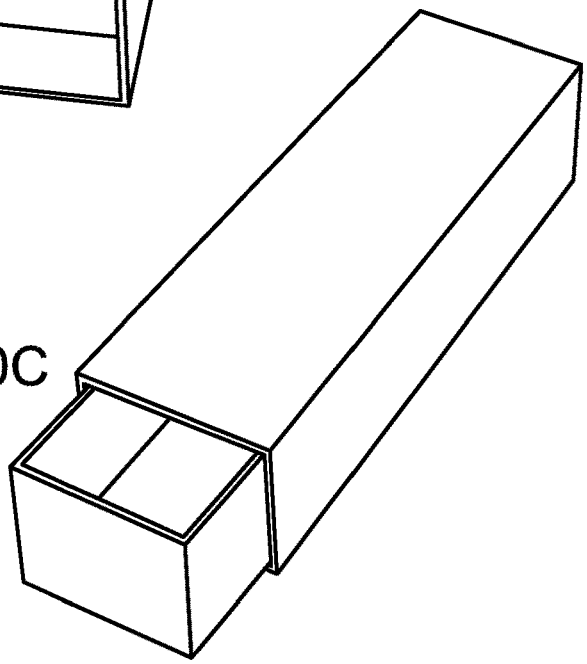

FIGS. 10A-10C illustrate the preferred embodiment in various stages of use. FIG. 10A illustrates the view of the device from the perspective of the slot after the inner rectangular box has been inserted into the outer rectangular box. FIG. 10B depicts the view from the back of the outer rectangular box after the inner rectangular box has been completely inserted into the outer rectangular box. FIG. 10C illustrates the device after the user has inserted a tool into the slot formed into the front horizontal wall (not shown) and partially "pushed out" the inner rectangular box from the outer rectangular box.

Figure 11:
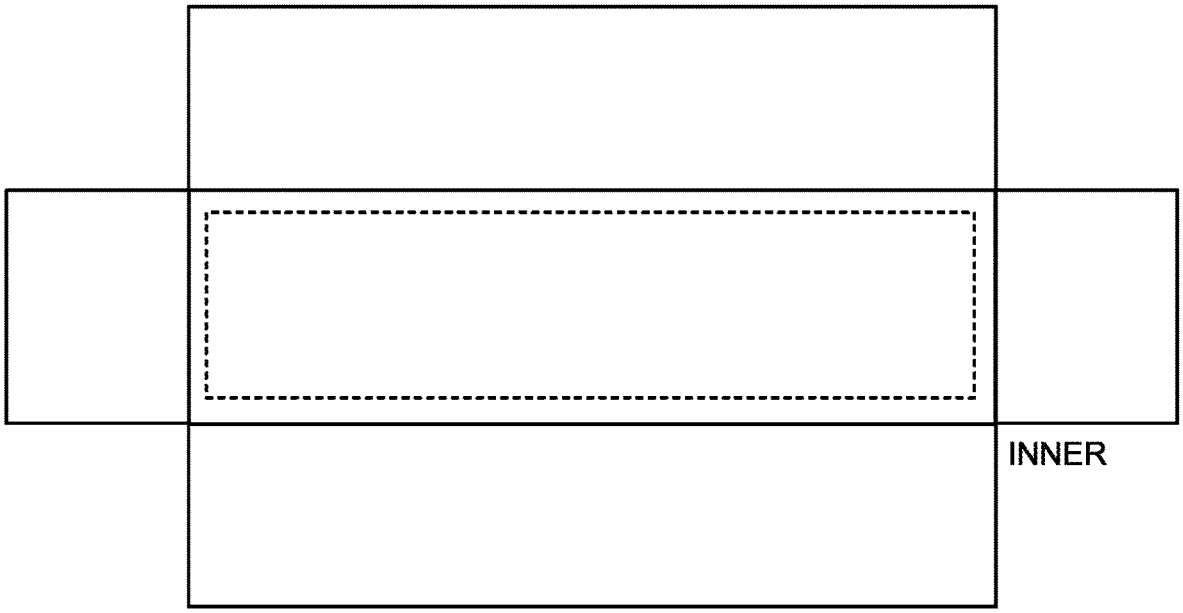
FIG. 11 are examples of the die cuts for the outer and inner boxes of the preferred embodiment.
Figure 11:
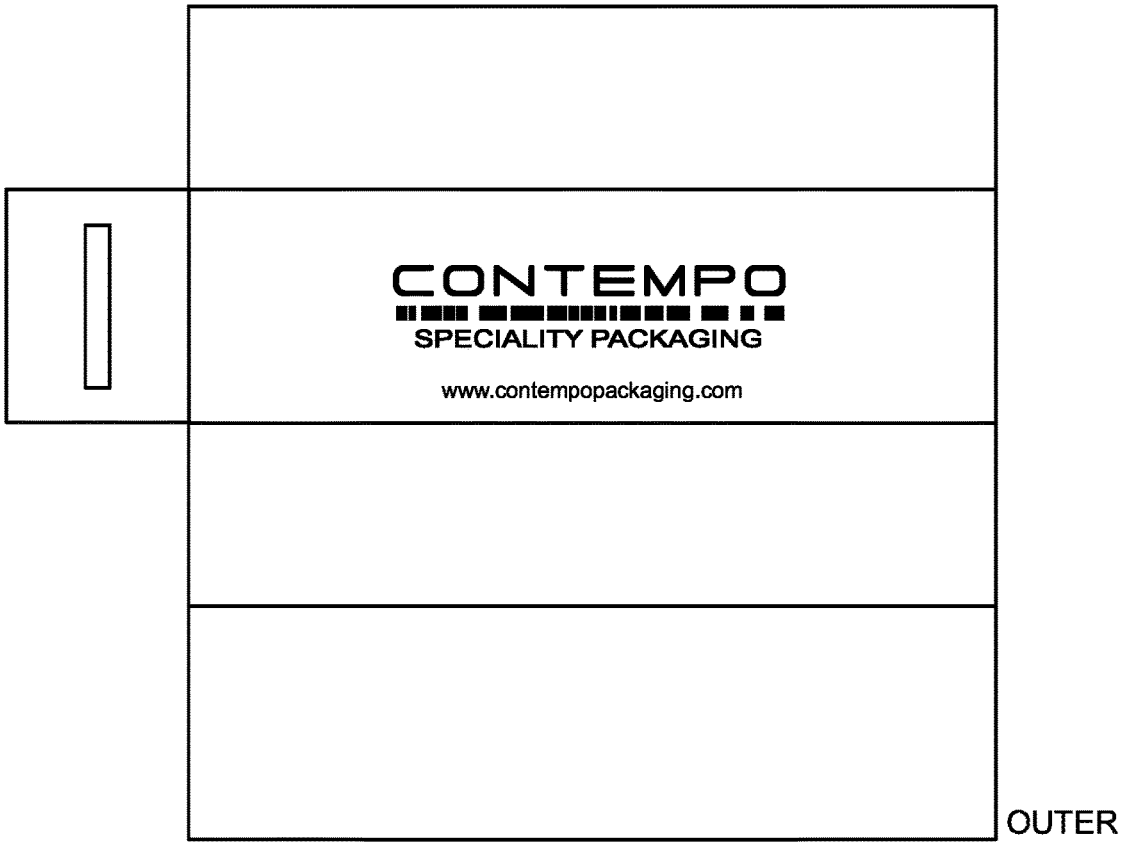

FIG. 11 is a depiction of the boxes of the preferred device prior to assembly. As shown, both the top box and bottom box may be formed from one sheet of material using known die cutting techniques, such as a die cutting machine. Indentations are pressed deeply into the die cuts to indicate where a fold is to be located and to insure sharp edges after folding. At this point, either one or both boxes may be covered with decorative paper that has the user's name, trademark, web address or other information printed thereon. In addition, decorative elements may also be printed on and/or attached to said paper. The paper is then glued onto the die cuts, indentations are pressed into the die cut and covering paper, and the boxes are folded. The die cuts may be folded by hand or by machine. As shown in FIG. 11, a layer of polyurethane charcoal foam is affixed to one of the exterior walls of the inner box prior to folding. The rectangular foam rubber strip may also be prepared using die cutting or stamping techniques. The foam rubber strip is attached to one of the exterior walls of the inner box prior to assembly. After folding, the various "free edges" are held together with glue and/or other known adhesives. The newly created corners may also be reinforced with staples, brackets, tape and/or any other known materials.

Figure 13:
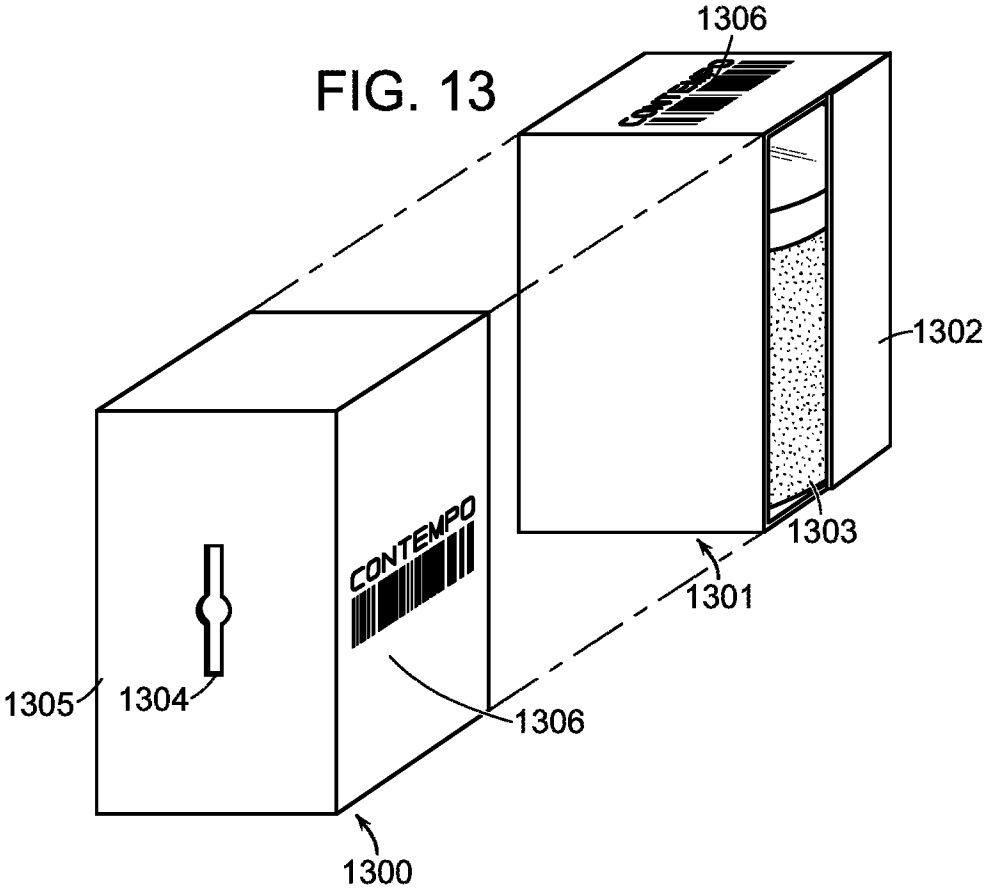
FIG. 13 is the embodiment of FIG. 14 in which the flap found on the trailing edge of the inner box has been pushed downward so as to be flush with the upper edges of the inner box.
Figure 12:
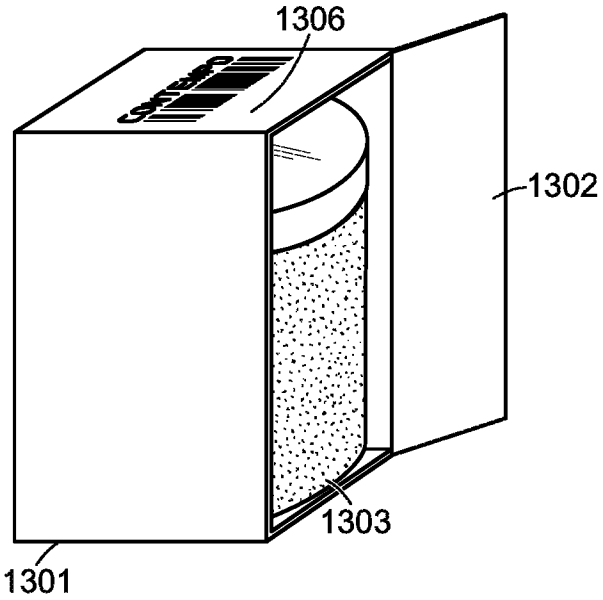
FIG. 12 is an example of an embodiment in which the inner box further comprises a flap.
Figure 14:
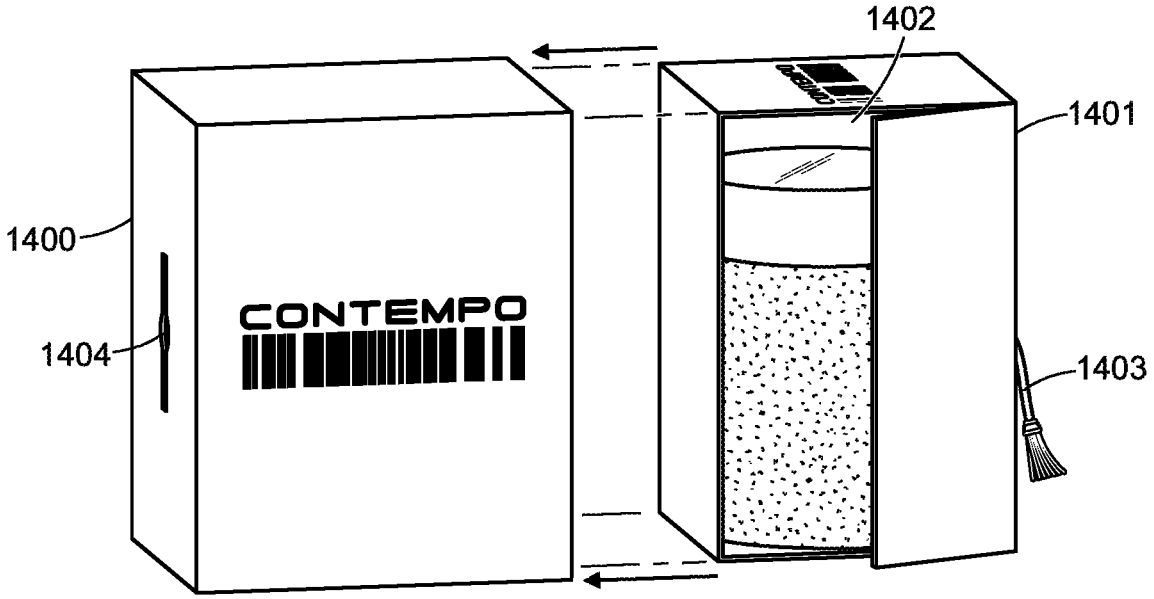
FIG. 14 is a further view of the embodiment of FIG. 12 which includes a pull on the inner box.

In yet another embodiment as depicted in FIGS. 12-14, the inner box 1301 may additionally include a flap 1302 formed at the upper edge of the vertical wall of the inner box 1301 that is closest to the open end of the outer box 1300 when the inner box 1301 is inserted into the outer box 1300. The additional flap 1302 found on the inner box 1301, when extended downward, prevents a small child from being able to grab the outer wall of the inner box 1301 and pull the inner box 1301 out of the outer box 1300 when the inner box 1301 is installed in the outer box 1300. This feature provides an additional layer of protection against a child who is able to manipulate the outer box 1300 (by squeezing the outer box) to access the inner box 1301 and "hook" their finger over the outer wall of the inner box 1301 to pull the inner box 1301 out of the outer box 1300, thereby accessing the contents 1303 of the inner box 1301. In this embodiment, the outer wall of the inner box 1301 prior to assembly (See FIG. 11, for example), is extended upward and a crease is formed in the extended outer wall that coincides with the upper most edges of the inner box 1301 so that when the extended outer wall of the inner box 1301 is folded downward at the crease, the flap 1302 is formed which is flush with the top edges of the vertical side walls of the inner box 1301. Once folded downward, the flap 1302 is primarily horizontal to the bottom horizontal wall of the inner box 1301, however, it is possible to push the flap 1302 into the interior of the inner box 1301 provided that no edge is formed that could be grabbed by a child. It should be appreciated that the flap 1302 may be a separate component prior to assembly that is affixed to the upper edge of the inner box 1302, as described, using any standard affixing means, such as, but not limited to, glue, epoxy and the like. The flap 1302 need not be made from the same material as the inner box 1301 to which it is attached. It should be appreciated that flap 1302 may extend the length of the inner box 1301 essentially covering the opening of the inner box 1301 or may extend only partially over the opening of the inner box 1301 as depicted in FIGS. 12-14.

FIG. 12, in particular, illustrates the inner box 1301, prior to installation in the outer box 1300. In this embodiment, the inner box 1301 contains a jar 1303. The flap 1302 extends upward to allow for the loading of the jar 1303 into the interior space of the inner box 1301. After the desired contents 1303 have been loaded into the inner box 1301, the flap 1302 is pushed downward, as described before, and the inner box 1301 is installed in the outer box 1300. The inner box 1301 may be marked with indicia 1306 or have a decorative element embossed thereon.

FIG. 13, in particular, illustrates the embodiment of FIG. 12, prior to the installation of the inner box 1301 into the outer box 1300. After loading the desired contents 1303 into the inner box 1301, the user "pushes" the flap 1302 of the inner box 1301 downward until it is flush with the upper edges of the vertical walls of the inner box 1301 and is generally parallel with the horizontal lower wall of the inner box 1301. Once the flap 1302 is properly positioned, the user inserts the inner box 1301 into the outer box 1300 until the inner box 1301 is completely inside the outer box 1301. In this embodiment, the inner box 1301 is slightly smaller than the outer box 1300 so that when the inner box 1301 is inserted into the outer box 1300, the vertical side wall of the inner box 1301 opposite of the vertical side wall 1305 of the outer box 1300 that contains the access slot 1304, is generally flush with the outer edges of the open end of the outer box 1300.

Figure 15:
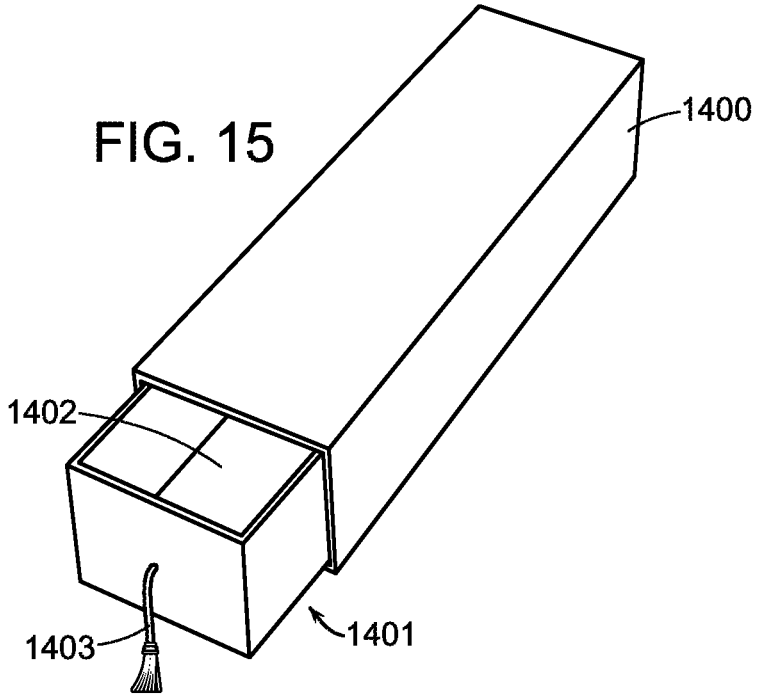
FIG. 15 is the embodiment of FIG. 10 further comprising a pull attached to one of the walls of the inner box.

FIG. 14, in particular, illustrates that action of inserting the inner box 1401 into the interior space of the outer box 1400. In this embodiment, the inner box 1401 further contains a "pull" 1403 allowing for the user to easily extract the inner box without having to use the access slot 1404. As designed, if the user does not need the container to be child resistant, they simply insert the inner box 1401 into the outer box 1400 so that the pull 1403 (in this example a tassel, however, it should be appreciated that anything that allows a user to pull the inner box 1401 out of the outer box 1400 may be employed, including, but not limited to, a tab, a hook, a loop, a cutout and the like) faces outward away from the wall of the outer box 1400 having the access slot 1404. To access the contents contained in the interior 1402 of the inner box 1401, the user pulls on the tassel 1403, thereby extracting the inner box 1401 from the outer box 1400. When the user needs the container to be child resistant, the user merely reverses the inner box 1401 so that the vertical side wall of the inner box 1401 that has the pull 1403 affixed thereon, is flush with the wall of the outer box 1400 having the access slot 1404. The user, thereafter, would need to access the inner box 1401 by inserting a thin object into the access slot 1404 to push to inner box 1401 out of the outer box 1400. FIG. 15 depicts the embodiment of FIGS. 10A-C having an access pull 1403 attached to the vertical wall of the inner box 1401 that is opposite of the wall of the outer box 1400 having the access slot (not shown). This embodiment illustrates a situation in which the user desires easy access to the contents 1402 of the inner box 1401 but does not need the container to be child resistant. When the user needs the container to be child resistant, they merely reverse the inner box 1401 so that that wall of the inner box 1401 with the pull 1403 is flush with the wall of the outer box 1400 having the access slot.

It should be appreciated that all of the aforementioned embodiments may also have boxes that are generally equal in size, like those embodiments depicted in FIGS. 12-14. As illustrated in these examples, both the inner box 1301/1401 and the outer box 1300/1400 may have indicia 1306 embossed on one or more of the outer walls. FIGS. 12-14 are also illustrative of an embodiment in which the inner 1301/1401 and outer boxes 1300/1400 generally have a cubic shape.

In yet another embodiment, the child resistant container may be designed as a "box-in-a-box", wherein the outer box contains a number of smaller inner boxes. The outer box would be formed with a number of access slots capable of accessing inner boxes retained therein. Both the inner and outer boxes would be formed consistent with the description of the single boxes as discussed above.

All of the aforementioned embodiments, the boxes may be reinforced with additional materials. For instance, a polymer film may be affixed to the outer walls of the inner and outer boxes to prevent tears. The film need not cover the entire outer walls as a strip of said film may need only cover the outer to edges and still make the boxers tear-resistant. Any commercially-available polymer may be used, however, a polymer that increases the static co-efficient of friction between the boxes, as well as being resistant to being torn, is preferred. Ideally, the polymer used should be transparent, able to be formed into a thin layer and not be "tacky" to the touch. The tear-resistant polymer may be applied prior to the assembling of the boxes or thereafter using any procedures known in the art used to coat materials. The film may be comprised of any known materials meeting the aforementioned requirement, such as, but not limited to SEEPS block copolymers, polyurethane, epichlorohydrin, polyester, latex rubber and any combination thereof The claimed device may also comprise an additional tamper-indication feature. In this embodiment, the device is affixed with means in which to indicate to the user that the contents of the inner box have been accessed. In one example, the device further comprises a cellophane sheet situated between the access slot of the outer rectangular box and the outer vertical wall of the inner rectangular box. When the tamper-indication feature is put in place, any attempt to access the inner rectangular box using the access slot would perforate the tamper-indication cellophane film alerting the user of the attempt. It should be appreciated that means to indicate unauthorized use of the device, not specifically described herein, may be employed.

A "rigid" type box is used in the preferred embodiment. It should be appreciated, however, that the claimed invention may be practiced using other types of boxes. Other box types that may be employed include, but are not limited to, match book, Simplex®, folding, folding carton, drawer style, lid-off, slipcase, paperboard, paperboard carton, set-up, window, one-piece, two-piece, nut and the like. In addition, the outer box and the inner box need not be of the same box type. For illustrative purposes only, it would be possible to use a drawer style box as the inner box and a rigid style box as the outer box.

The various boxes made be manufactured using a variety of materials, including but not limited to, board, cardboard, reinforced cardboard, paper, paperboard, chipboard, wood, plastic such as PVC, ceramic, glass, and/or metals such as tin and aluminum. The "boxes" of the claimed child resistant storage device of the instant application can made by hand or machine or using an additive manufacturing process ("3D printing"), laser cutting, molding, vacuum forming or thermal forming, or any other known processes used to manufacture such items, as one unit. The walls of the "boxes" may also be individually formed and later assembled. For example, each wall can be individually constructed using one or more of stamping, machining, working, casting, extrusion, or any combinations of these. Various types of adhesives may be used to assemble the parts into the components. It is preferable, however, to integrally form the box as one complete unit as depicted in FIG. 11 using techniques available in the art such as die cutting, because the strength of the device is increased. It is imperative that high friction materials having static coefficients of friction that are higher than its dynamic coefficients of friction be selected or that the contact walls be coated with a material that does, such as foam.

The boxes may be formed with two layers. The inner layer consists of a flat folding "box," like boxes that hold standard tubes of toothpaste, with a rigid "box", like those discussed above, on the outside. The user would be able to extract the inner box, discard after use, and insert a new flat folding box into the original rigid box of the present invention.

The sizes and dimensions of the boxes may vary provided that the inner rectangular (or other shape) box must fit snugly within the outer rectangular (or other shape) box so that it neither be removed by simple shaking nor grasped and pulled out. The objective of the instant invention is that the inner "box" can only be extracted from the outer "box" by inserting a thin object inserted into the slot of the outer "box" and pushing the inner "box" out of the outer "box", however, the slot is not large enough to allow a child's finger to be able to access the inner "box".

The narrow slot 107 embedded in the front horizontal wall 105 may be formed when the outer "box" is originally constructed or may be "punched out" after the outer "box" is constructed. The width and length of the slot may vary. The thickness of the walls may vary.

The exterior of the outer rectangular box may be decorated or embossed with a company's trademark or logo (FIG. 11). In other examples, a pin or other tool is attached to the outer rectangular box. The pin and tool, which is attached via a chain-like connector, can be used to access the inner box. A holding means may also be included to secure the pin/tool to the device when not in use. In yet another embodiment, one or more of the boxes may be formed with a "tool-like" perforation that can be torn from the device when the user wishes to access the interior box. Another embodiment utilizes a "peel away" function wherein a portion of the outer box may be torn off providing the user access to the inner box. The user would simply push the inner box out of the outer box. This embodiment allows for one use and cannot be used again after the initial "peel away" is removed.

In another embodiment, the outer box does not have a slot. The inner box is formed with a "hooking" means, such as an outward circular extension or slot. The device contains a relatively long hook like device. When the user wants to extract the inner box from the outer box, he/she uses the hooking device to engage the hooking means, i.e. circular extension or slot, and pulls the inner box out of the out box.

It should be appreciated that the claimed device need not utilize components of the same shape. For instance, the inner box may be replaced with a glass or tin tube coated with foam or other high-friction material, provided that said tube remains completely within the outer housing when the claim device is shaken. The user would access the inner glass/tin tube by inserting a coin or other flat time into the slot in the outer casing. In this example, the inner glass/tin tube can contain processed cannabis leaves or liquids, such as cannabis oils and the like. The claimed storage container may also be designed to secure a clam shell case. It may also be designed to accommodate more than one interior box.

The instant invention does not use clips or tab cutouts to be found in prior art child-resistant containers. Clips tend to break and fall out of other child-resistant products whereas tabs tend to rip. Once these components become non-functional, the prior art devices are no longer child-resistant. The claimed device does not utilize similar components, remaining child-resistant for the life of the product, not just for the initial use.

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the disclosure believed to be of particular importance, it should be understood that the Applicant claims protection in respect of any patentable feature or combination of features hereinbefore referred to and/or shown in the drawings whether or not particular emphasis has been placed thereon.

Unless otherwise indicated, all numbers expressing quantities of claimed features, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present invention.

The above discussion is meant to be illustrative of the principle and various embodiments of the present invention. Numerous variations and modifications will become apparent to those skilled in the art once the above disclosure is fully appreciated. It is intended that the following claims be interpreted to embrace all such variations and modifications.

We claim:

1. A storage container comprising an outer box having an interior space, an inner box capable of being inserted into and contained in the interior space of said outer box, and a means of accessing the inner box when the inner box is inserted into the outer box provided that there is sufficient friction between the contact surfaces of the inner box and the outer box to retain the inner box within the outer box;

wherein said outer box is comprised of five walls and an opening in which to insert the inner box into the interior space of the outer box and the inner box is comprised of four vertical side walls and a bottom horizontal wall, further wherein the length of the inner box is shorter than the length of the outer box provided that when the inner box is inserted into the outer box, the inner box cannot be retrieved by reaching into the outer box and pulling the inner box out of the outer box wherein said means of accessing the inner box when the inner box is inserted into the outer box is one or more slots formed within one or more of the walls of the outer box provided said slots are not large enough for a child's finger to access said inner box; and further provided that the means of accessing the inner box is the only means in which to extract the inner box from the outer box.

2. The storage container according to claim 1, where said container is compliant with The Poison Prevention Act and Title 16, Part 1700 of the U.S. Code of Federal Regulations.

3. The storage container according to claim 1, wherein said outer and inner boxes are rigid.

4. The storage container according to claim 3, wherein said the height and width of the inner box is slightly less than the height and width of the outer box provided that when the inner box is inserted into the outer box the inner box is retained in the outer box.

5. The storage container according to claim 1, wherein said one or more slots are no wider than the width of and no longer than the length of a U.S. quarter, U.S. nickel or U.S. penny.

6. The storage container according to claim 1, wherein the outer box and the inner box are constructed from a material having a static co-efficient of friction greater than its dynamic co-efficient of friction or coated with a material having a static co-efficient of friction greater than its dynamic co-efficient of friction.

7. The storage container according to claim 1, wherein the outer box or the inner box is coated with a material having a static co-efficient of friction greater than the dynamic co-efficient of friction wherein said coating is polyurethane charcoal foam die cut into one or more affixed to one or more inner wall of the outer box or one or more outer wall of the inner box or one or more walls of either the outer or inner boxes using an adhesive.

8. The storage container according to claim 1, further comprising a sleeve that fits over the inner box prior to insertion into the outer box wherein said sleeve is manufacture from or is coated with a material having a static co-efficient of friction greater than its dynamic co-efficient of friction.

9. The storage container according to claim 1, wherein said boxes are rectangular, cylindrical, octagonal or triangular.

10. The storage container according to claim 1, further comprising means in which to reinforce the outer box and the inner box.

11. The storage container according to claim 1, wherein said boxes are manufacture from a material selected from the group consisting of board, cardboard, reinforced cardboard, paper, paperboard, chipboard, wood, plastic, PVC, ceramic, glass, tin and aluminum.

12. The storage container according to claim 1, wherein said boxes are manufactured by hand, machining, die cutting, an additive manufacturing process ("3D printing"), laser cutting, molding, vacuum forming, thermal forming, stamping, casting or extrusion, or any combinations thereof.

13. The storage container according to claim 1, further comprising an attached tool used to access said inner box when said inner box is inserted into said outer box wherein said tool is a detachable pin or a perforated section of the outer box that is torn off from the outer box prior to use.

14. The storage container according to claim 1, further comprising means in which to prevent access to said inner box contained in said outer box after said outer box is deformed wherein said means in which to prevent access to said inner box when said outer box is deformed comprises a flap affixed to the vertical side wall of the inner box that is parallel with the wall of the outer box containing the one or more slots;

further wherein said flap is formed by folding a crease formed into vertical side wall of the inner box that is parallel with the wall of the outer box containing the one or more slots, wherein when said flap is formed, access to the interior of the inner box by reaching into the opening in the outer box is restricted.

15. The storage container according to claim 1, further comprising a tear-resistant, laminate coating wherein said tear-resistant, laminate coating is applied as a film to all or a part of one or more of the boxes.

16. The storage container according to claim 1, further comprising means in which to extract the inner box after said inner box is installed in said outer box wherein said means in which to extract the inner box is a rope, tassel, loop or pull affixed to the horizontal wall of the inner box that is parallel with the wall of the outer box having the one or more slots, provided that when the user of the storage container desires the container to be child resistant, the user inserts the inner box with the wall having the rope, tassel, loop or pull facing the wall of the outer box having the one or more slots.

17. The storage container according to claim 1, further comprising means in which to indicate unauthorized access of the inner box wherein said means in which to indicate the unauthorized access of the inner box comprises a cellophane film.

* * * * *